US009428862B2

(12) United States Patent
Higuchi et al.

(10) Patent No.: US 9,428,862 B2
(45) Date of Patent: Aug. 30, 2016

(54) SHEET MANUFACTURING APPARATUS

(71) Applicant: SEIKO EPSON CORPORATION, Tokyo (JP)

(72) Inventors: Naotaka Higuchi, Fujimi-machi (JP); Masahide Nakamura, Nagano (JP); Kazuma Miyazawa, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/664,208

(22) Filed: Mar. 20, 2015

(65) Prior Publication Data

US 2015/0275429 A1 Oct. 1, 2015

(30) Foreign Application Priority Data

Mar. 26, 2014 (JP) ..... 2014-063246

(51) Int. Cl.

| | |
|---|---|
| ***B07B 1/22*** | (2006.01) |
| ***B27N 3/04*** | (2006.01) |
| ***D21B 1/06*** | (2006.01) |
| ***D21F 9/04*** | (2006.01) |
| ***D21F 11/00*** | (2006.01) |

(52) U.S. Cl.

CPC . *D21F 9/04* (2013.01); *B07B 1/22* (2013.01); *B27N 3/04* (2013.01); *D21B 1/06* (2013.01); *D21F 11/00* (2013.01)

(58) Field of Classification Search

CPC ..... D21D 5/24; D21D 5/00; B27N 3/04; B27N 3/12; D21H 11/14; D21H 25/005; D04H 1/732; A61F 2013/530007; B07B 9/00; B07B 1/00; D21C 5/025; D21B 1/08; D21B 1/028; D21B 1/063; D21B 1/32; D21F 9/04; D21F 11/00

See application file for complete search history.

(56) References Cited

U.S. PATENT DOCUMENTS

| | | | | |
|---|---|---|---|---|
| 2,646,381 | A * | 7/1953 | Duvall | B27N 1/00 19/58 |
| 2,972,171 | A * | 2/1961 | Heritage | D21D 5/00 162/55 |
| 3,418,095 | A * | 12/1968 | Kleist | C03B 37/06 264/12 |
| 3,611,508 | A * | 10/1971 | Reinhall et al. | D04H 1/425 19/303 |
| 3,717,905 | A * | 2/1973 | Furbeck | A61F 13/15626 19/148 |
| 4,440,635 | A * | 4/1984 | Reiniger | B02C 18/08 209/306 |
| 5,013,405 | A * | 5/1991 | Izard | C04B 26/02 162/101 |

(Continued)

FOREIGN PATENT DOCUMENTS

| | | | | |
|---|---|---|---|---|
| DE | WO 0071810 A1 * | 11/2000 | | B07B 4/02 |
| JP | 07-003603 A | 1/1995 | | |

(Continued)

OTHER PUBLICATIONS

14/664,208, Jose Fortuna, 1741.*

*Primary Examiner* — Jose Fortuna

(74) *Attorney, Agent, or Firm* — Global IP Counselors, LLP

(57) ABSTRACT

A sheet manufacturing apparatus includes: a defibrating unit which defibrates a defibration object including fibers; a cylinder unit which allows a defibrated material which is defibration-processed in the defibrating unit to pass through a plurality of holes that is on a cylindrical surface by rotating; a housing unit which covers the cylinder unit so that the plurality of holes is included therein; a supplying unit which supplies additive agents that bonds the plurality of fibers, on an outer side of the cylinder unit to an inner side of the housing unit; and a bonding unit which forms a sheet by bonding the fibers and the additive agents.

6 Claims, 6 Drawing Sheets

(56) References Cited

U.S. PATENT DOCUMENTS 5,324,389 A * 6/1994 Spencer ..... D21B 1/028 162/4
5,437,418 A * 8/1995 Graef ..... A61F 13/15707 241/152.2
8,882,965 B2 * 11/2014 Yamagami ..... D21B 1/08 162/261
8,986,505 B2 * 3/2015 Oguchi ..... B07B 1/00 162/259
9,045,857 B2 * 6/2015 Gomi ..... D21B 1/063
9,174,243 B2 * 11/2015 Nakamura ..... D21D 99/00
2005/0064169 A1 * 3/2005 Schiegl ..... B27N 1/0254 428/297.4
2012/0297560 A1 * 11/2012 Zwick ..... C11D 3/046 15/104.93
2014/0027075 A1 * 1/2014 Yamagami ..... D21B 1/08 162/4
2014/0290887 A1 * 10/2014 Gomi ..... D21B 1/063 162/252
2014/0290889 A1 * 10/2014 Oguchi ..... B07B 1/00 162/259
2014/0374047 A1 * 12/2014 Yamagami ..... D21B 1/08 162/261
2015/0090416 A1 * 4/2015 Nakamura ..... D21D 99/00 162/263
2015/0096701 A1 * 4/2015 Higuchi ..... B02C 4/10 162/261
2015/0096702 A1 * 4/2015 Higuchi ..... D21D 5/24 162/261
2015/0184341 A1 * 7/2015 Tanaka ..... D21F 7/00 162/252
2015/0240417 A1 * 8/2015 Higuchi ..... D21B 1/06 162/261
2015/0240418 A1 * 8/2015 Oguchi ..... D21D 5/24 162/109
2015/0240422 A1 * 8/2015 Oguchi ..... D21F 9/00 162/202
2015/0247286 A1 * 9/2015 Nagai ..... D21F 7/003 162/261
2015/0251867 A1 * 9/2015 Higuchi ..... B65H 20/10 226/95
2015/0252530 A1 * 9/2015 Higuchi ..... D21F 2/00 162/363
2015/0275429 A1 * 10/2015 Higuchi ..... D21F 9/04 162/261
2015/0275430 A1 * 10/2015 Higuchi ..... D21F 9/04 162/261
2015/0275435 A1 * 10/2015 Seki ..... D21H 17/20 162/5
2015/0292153 A1 * 10/2015 Miyazawa ..... D21D 5/24 162/261

FOREIGN PATENT DOCUMENTS

JP WO 9720090 A1 * 6/1997 ..... B41J 2/17413
JP 2001140184 A * 5/2001
JP WO 2010053035 A1 * 5/2010 ..... F26B 11/16
JP 5214407 B2 * 6/2013 ..... F26B 11/16
WO WO 2012095928 A1 * 7/2012 ..... D21B 1/08

* cited by examiner

SHEET MANUFACTURING APPARATUS

BACKGROUND

1. Technical Field

The present invention relates to a sheet manufacturing apparatus.

2. Related Art

Obtaining a sheet-shaped or film-shaped molded body by depositing a fibrous material and exerting a combining force between the deposited fibers has been performed from old times. A typical example thereof includes manufacturing a paper sheet by paper-making using water. Even in these days, paper-making method is widely used as one of the manufacturing methods of the paper sheet. In many cases, the paper sheet which is manufactured by the paper-making method has a structure in which cellulose fibers derived from wood are intertwined with each other, form hydrogen bonding, and further, are partially bonded to each other by a binder (paper strengthening agent (starch paste or water-soluble resin)).

Meanwhile, in JP-A-7-3603, a manufacturing method of a molded body made of waste paper fibers, in which a dry type waste paper defibrating machine that does not use water is used, is disclosed. In the manufacturing method, making a mixture of the binder of a synthesized resin and the waste paper fibers into a molded article by pressing and heating is described.

However, in the manufacturing method described in JP-A-7-3603, the binder is mixed before defibrating the waste paper sheet. For this reason, when the temperature increases inside the waste paper defibrating machine, a state where the binder starts melting, is not sufficiently scattered with respect the waste paper fibers, and partially coagulates, is considered. In addition, in the technology of JP-A-7-3603, it can be found that the binder is not sufficiently mixed and scattered before defibration since a solution of the binder is coated before pressing and heating the mixture. In addition, in a case where a classifying unit for deinking after defibration is provided, if the binder is mixed before defibration, a resin which is smaller than fibers and having light specific gravity is classified and removed from a system. In addition, in a case where the sheet is formed by a dry method, if the binder is liquid, coagulation of the fibers is generated, for example, it is difficult to pass through openings of a sieve. For this reason, it is difficult to uniformly perform depositing and molding by using the sieve.

SUMMARY

An advantage of some aspects of the invention is to provide a sheet manufacturing apparatus which can mix fibers and additive agents which are bonded to the plurality of fibers in the atmosphere, and can form a sheet having excellent uniformity.

The invention can be realized in the following forms or application examples.

According to an aspect of the invention, there is provided a sheet manufacturing apparatus, including: a defibrating unit which defibrates a defibration object including fibers; a cylinder unit which allows a defibrated material which is defibration-processed in the defibrating unit to pass through a plurality of holes that is on a cylindrical surface by rotating; a housing unit which covers the cylinder unit so that the plurality of holes is included therein; a supplying unit which supplies additive agents that bond the plurality of fibers, on an outer side of the cylinder unit to an inner side of the housing unit; and a bonding unit which forms a sheet by bonding the fibers and the additive agents.

In this case, it is possible to supply the additive agents with respect to the defibrated material which passes through the holes of the cylinder unit. Accordingly, since the additive agents are mixed with respect to the fibers that are scattered by passing through the holes of the cylinder unit, it is possible to efficiently and excellently mix the fibers and the additive agents. For this reason, according to the sheet manufacturing apparatus, it is possible to manufacture a sheet having high uniformity in which uneven distribution of the fibers or the additive agents is suppressed.

In the sheet manufacturing apparatus according to the aspect of the invention, a supply port which supplies the additive agents in the supplying unit may be disposed to be apart above the cylindrical surface of the cylinder unit.

In this case, since the supply port is disposed to be apart above the cylindrical surface of the cylinder unit, a member of the supplying unit does not block dispersion of the defibrated material which passes through the holes. In addition, since the additive agents are supplied from above to an inner side of the housing unit, it is possible to efficiently mix the additive agents with the fibers that are dispersed in the housing. In addition, even when the additive agents are adhered to the cylinder unit, it is possible to disperse the additive agents on the inner side of the housing unit by a centrifugal force which is generated by the rotation of the cylinder unit.

In the sheet manufacturing apparatus according to the aspect of the invention, a supply port which supplies the additive agents in the supplying unit may be disposed to be apart from the cylindrical surface of the cylinder unit in a horizontal direction.

In this case, since the additive agents are supplied to a position which is apart from the cylinder unit in the horizontal direction, it is possible to reduce a proportion of the additive agents which comes into contact with the cylinder unit due to an operation of gravity. Accordingly, clogging of the holes of the cylinder unit is unlikely to be generated, and it is possible to more excellently mix the defibrated material and the additive agents.

In the sheet manufacturing apparatus according to the aspect of the invention, the supply unit may include a distribution mechanism which distributes and supplies the additive agents in an extending direction of a rotation axis of the cylinder unit.

In this case, it is possible to distribute and supply the additive agents in a direction along the rotation axis of the cylinder unit. Accordingly, it is possible to more excellently mix the defibrated material with the additive agents.

The sheet manufacturing apparatus according to the aspect of the invention, may further include an introduction port which introduces the defibrated material to the cylinder unit. The introduction port may be disposed on one end side of the rotation axis of the cylinder unit in the extending direction. The distribution mechanism may distribute more additive agents to the one end side than to the other end side of the rotation axis of the cylinder unit in the extending direction.

In this case, the distribution mechanism distributes more additive agents to one end side. For this reason, according to the sheet manufacturing apparatus, since the defibrated material is supplied from the introduction port on one end side, more amount of the defibrated material which passes through the holes of the cylinder unit is on one end side, and the distribution mechanism distributes more additive agents to one end side. According to this, it is possible to more excellently mix the defibrated material and the additive agents.

The sheet manufacturing apparatus according to the aspect of the invention, may further include an introduction port which introduces the defibrated material into the cylinder unit. The introduction port may be disposed on one end side of a rotation axis of the cylinder unit in an extending direction. A supply port which supplies the additive agents in the supplying unit may be provided at a position which is close to one end side of the rotation axis of the cylinder unit in the extending direction.

In this case, more additive agents are supplied to one end side. For this reason, according to the sheet manufacturing apparatus, since the defibrated material is supplied from the introduction port on one end side, more amount of the defibrated material which passes through the holes of the cylinder unit is on one end side, and more additive agents are supplied to one end side. According to this, it is possible to more excellently mix the defibrated material and the additive agents.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
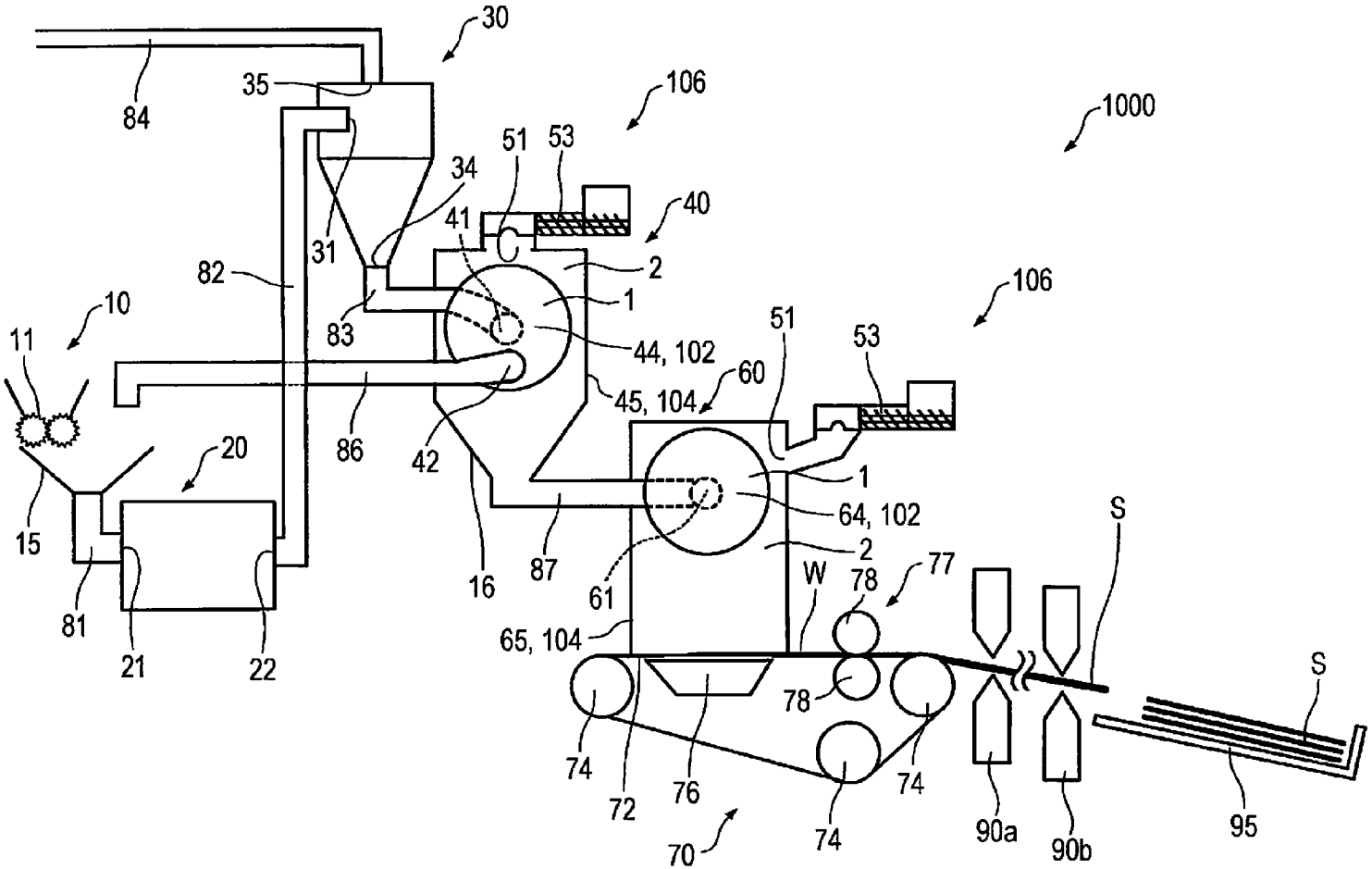
FIG. 1 is a schematic view of a sheet manufacturing apparatus according to an embodiment.

Hereinafter, some embodiments of the invention will be described. The embodiments to be described below describe an example of the invention. The invention is not limited to the embodiments to be described below, and includes various modified embodiments which are realized without departing from the scope of the invention. In addition, all of the configurations to be described below are not always essential configurations of the invention.

A sheet manufacturing apparatus 1000 according to the embodiment includes at least a defibrating unit 20, a cylinder unit 102, a housing unit 104, a supplying unit 106, and a bonding unit 77. Among these, since the cylinder unit 102, the housing unit 104, and the supplying unit 106 configure a part of each of a screening unit 40 and/or a refining unit 60, the cylinder unit 102, the housing unit 104, and the supplying unit 106 will be described in sections of the screening unit 40 and the refining unit 60.

Figure 3:
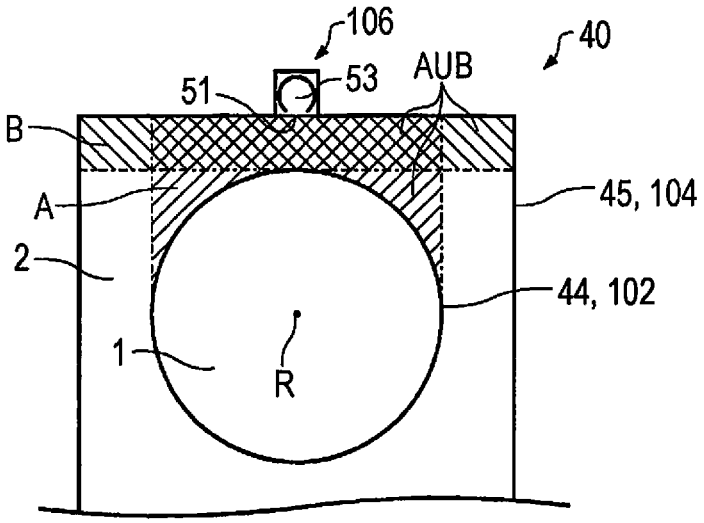
FIG. 3 is a schematic view when a cylinder unit and a housing unit of the embodiment are viewed from a direction along a rotation axis.
Figure 4:
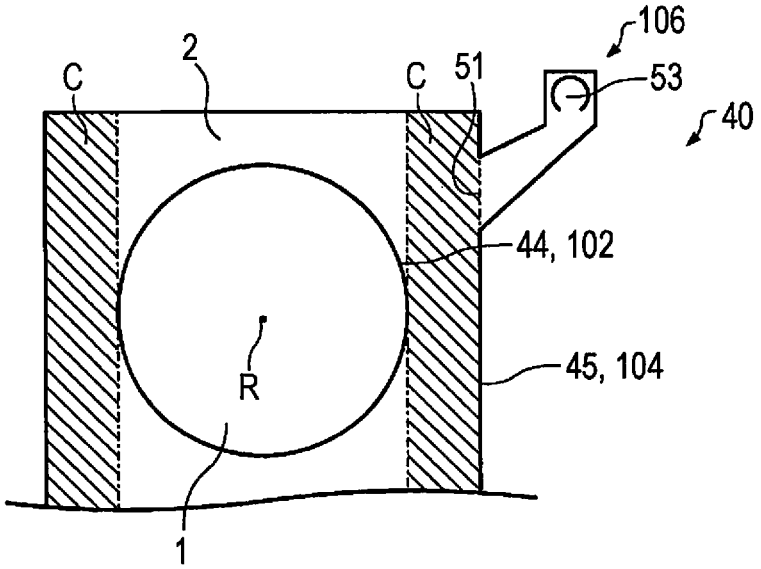
FIG. 4 is a schematic view when the cylinder unit and the housing unit of the embodiment are viewed from the direction along the rotation axis.

FIG. 1 is a schematic view of the sheet manufacturing apparatus 1000 according to the embodiment. FIGS. 3 and 4 are respectively schematic views when the cylinder unit 102 and the housing unit 104 are viewed from a direction along a rotation axis R.

1. Defibrating Unit

The sheet manufacturing apparatus 1000 of the embodiment includes the defibrating unit 20. The defibrating unit 20 performs defibration-processing with respect to a defibration object. As the defibration processing is performed with respect to the defibration object, the defibrating unit 20 generates a defibrated material which is untangled in a fibrous form. In addition, the defibrating unit 20 has a function of separating materials, such as resin grains, ink, toner, or blur-preventing agent, which are adhered to the defibration object, from fibers.

Here, "defibration processing" means untangling the fibers in the defibration object which is made by bonding the plurality of fibers one by one. The material which passes through the defibrating unit 20 is called the "defibrated material". There is a case where examples of the "defibrated material" include materials, such as the resin (resin for bonding the plurality of fibers to each other) grains which are separated from the fibers when untangling the fibers, ink, toner, or blur-preventing agent, in addition to the disentangled fibers. A shape of the disentangled defibrated material is a string shape or a ribbon shape. The disentangled defibrated material may exist in a state of not being intertwined with other disentangled fibers (a state of being independent), or may exist in a state of being intertwined with other disentangled fibers in a massed shape (a state where a so-called "lump" is formed).

In the specification, in the sheet manufacturing apparatus 1000, with respect to a flow (including a schematic flow) of a material (raw material, defibration object, defibrated material, additive agent, web, sheet, or the like) of the sheet to be manufactured, expressions, such as "upstream" or "downstream", are used. In addition, an expression "upstream side (downstream side)" is used when a position of constituent elements is relatively specified. For example, "A is on the upstream side (downstream side) of B" means that a position of A is upstream (downstream) with respect to a position of B with reference to the flow direction of the material of a sheet S.

In addition, in the specification, a dry method does not mean a method in liquid, but means a method in the atmosphere (in the air). In a category of the dry method, a dry state, and a state where the liquid which exists as impurities or the liquid which is added intentionally, exists, are included.

The defibrating unit 20 is any arbitrary unit as long as the unit has a function of performing the defibration processing of the defibration object. The defibrating unit 20 performs defibration by the dry method in the atmosphere (in the air). In the example in the drawing, the defibration object which is introduced from an introduction port 21 is defibrated by the defibrating unit 20, and becomes the defibrated material (fibers). The defibrated material which is discharged from the discharge port 22 is configured to be discharged to a tube (pipe) 82.

The configuration of the defibrating unit 20 is not particularly limited, and examples of the configuration can include a configuration which has a rotary unit (rotor) and a stationary unit that covers the rotary unit and forms a void (gap) between the rotary unit and the stationary unit. When the defibrating unit 20 is configured in this manner, as the defibration object is introduced into the gap in a state where the rotary unit rotates, the defibration processing is performed. In addition, in this case, the number of revolution of the rotary unit, a shape of the rotary unit, a shape of the stationary unit, or the like, can be appropriately designed by requirements for properties of the sheet to be manufactured or the configuration of the entire apparatus. In addition, in this case, a rotational speed of the rotation unit (revolutions per minute (rpm)), or the like, can be appropriately set in consideration of conditions, such as throughput of the defibration processing, retention time of the defibration object, an extent of defibration, a size of the gap, or the shape or the size of the rotary unit, the stationary unit, and each of other members.

In addition, it is more preferable that the defibrating unit 20 has a function of generating an air current (airflow) to suck in the defibration object and/or discharge the defibrated material. In this case, the defibrating unit 20 generates an air current and uses the generated air current to draw in the defibration object from the introduction port 21, defibrates, and transfers the defibrated material to the discharge port 22. In addition, when the defibrating unit 20 which does not include an air current generating mechanism is used, providing an external mechanism which generates an air current that introduces the defibration object into the introduction port 21 or an air current which sucks the defibrated material from the discharge port 22, is not a problem.

1.1. Defibration Object

In the specification, the defibration object indicates matter which includes raw materials of the sheet manufacturing apparatus 1000, and examples thereof include a material which is intertwined or bonded with the fibers, such as pulp sheets, paper sheets, waste paper sheets, tissue paper sheets, kitchen paper sheets, cleaning agent, filters, liquid absorbents, sound-absorbing materials, cushioning materials, matting materials, or corrugated cardboard. In addition, in the specification, the defibration object may be a sheet manufactured by the sheet manufacturing apparatus 1000, or may be the sheet (waste sheet) after use. In addition, the defibration object may include fibers (organic fibers, inorganic fibers, and organic-inorganic composite fibers) or the like which are constituted of rayon, lyocell, cupra, vinylon, acryl, nylon, aramid, polyester, polyethylene, polypropylene, polyurethane, polyimide, carbon, glass, or metal. In addition, in the sheet manufacturing apparatus 1000 of the embodiment, when a classifying unit 30 which will be described later is provided, it is possible to effectively use, in particular, waste paper sheets or the waste sheets, as the defibration object.

1.2. Defibrated Material

In the sheet manufacturing apparatus 1000 of the embodiment, the defibrated material is used as a part of the material of the sheet to be manufactured. The defibrated material includes the fiber which is obtained by performing the defibration processing of the above-described defibration object, and examples of the fiber include natural fibers (animal fibers and vegetable fibers), or chemical fibers (organic fibers, inorganic fibers, and organic-inorganic composite fibers). More specifically, examples of the fibers included in the defibrated material include fibers derived from cellulose, cotton, silk, wool, hemp, kenaf, flax, ramie, jute, Manila hemp, sisal hemp, conifer, or broadleaf tree. These examples may be used independently, may be used by being appropriately mixed, or may be used as regenerated fibers in which refining or the like is performed. The defibrated material becomes the material of the sheet to be manufactured, but may include at least one type of these fibers. In addition, the defibrated material (fibers) may be dried, or may contain or impregnate the liquid, such as water or an organic solvent. Furthermore, in the defibrated material (fibers), various types of surface treatments may be performed.

When the fiber included in the defibrated material which is used in the embodiment is one independent fiber, an average diameter (the longest length in a direction which is perpendicular to a longitudinal direction when a cross section is not a circle, or a diameter of the circle (equivalent circle diameter) when the circle is assumed to be a circle which has an area equivalent to an area of the cross section) thereof is 1 μm to 1000 μm, is preferably 2 μm to 500 μm, and is more preferably 3 μm to 200 μm.

The length of the fiber included in the defibrated material which is used in the embodiment is not particularly limited, but as one independent fiber, the length of the fiber along the longitudinal direction is, for example, 1 μm to 5 mm, is preferably 2 μm to 3 mm, and is more preferably 3 μm to 2 mm. When the length of the fiber is short, since the fiber is unlikely to be bonded by the resin, there is a case where the strength of the sheet is not sufficient, but if the length is within the above-described range, it is possible to obtain the sheet having sufficient strength. In addition, the average length of the fiber as a length-weighted mean fiber length is 20 μm to 3600 μm, is preferably 200 μm to 2700 μm, and is more preferably 300 μm to 2300 μm. Furthermore, the length of the fiber may have unevenness (distribution).

In the specification, when the fiber is referred, there is a case where one fiber is indicated, and there is a case where a bundle of a plurality of fibers (for example, a state of being in a cotton shape) is indicated. In addition, when the defibrated material is referred, the material which is included in the plurality of fibers is indicated, and a meaning of the fiber bundle and a meaning of a material (material in a powder-like shape or a cotton shape) which becomes the material of the sheet are included.

The defibrated material which passes through the defibrating unit 20 is mixed with the additive agents until a sheet shape is formed. It is possible to extremely easily perform mixing as a configuration (for example, the screening unit 40 and/or the refining unit 60) in which the cylinder unit 102, the housing unit 104 and the supplying unit 106 are provided is employed.

2. Bonding Unit

The sheet manufacturing apparatus 1000 of the embodiment is provided with the bonding unit 77. The bonding unit 77 heats the mixture of the defibrated material which passes through the configuration (for example, the screening unit 40 and/or the refining unit 60 which will be described later) in which the cylinder unit 102, the housing unit 104, and the supplying unit 106 are provided, and the additive agents, and forms the plurality of fibers in the defibrated material to be in a state where the fibers are bonded to each other via the resin in the mixture. The mixture may be formed into a predetermined shape (for example, a web shape) before reaching the bonding unit 77. In addition, the bonding unit 77 may have a function of forming the mixture in the predetermined shape.

In the bonding unit 77, by applying heat to the mixture of the fibers (defibrated material) and the resin (additive agent), the plurality of fibers in the mixture are bonded to each other via the resin. When the resin is a thermoplastic resin, if heating is performed to reach a glass transfer temperature (softening point) or a temperature which is equal to or greater than the vicinity of a melting point (in a case of a crystalline polymer), the resin is softened or melted, and after this, when the temperature decreases, the resin is hardened. As the resin is hardened, comes into contact with the fibers to be intertwined, and is solidified, it is possible to bond the fibers and the additive agents to each other. In addition, as proximate fibers are bonded when the resin is solidified, the fibers are bonded to each other. In addition, the resin may have components remains without being melted and flowing in the bonding unit 77.

In the specification, an expression "bond the fibers and the resin" means a state where the fibers and the resin are unlikely to be separated from each other or a state where the resin of the additive agent is disposed between the fibers, and it is difficult to separate the fibers from each other via the resin. In addition, the bonding is a concept which includes adhesion, and includes a state where two or more types of objects are in contact with each other and unlikely to be separated from each other. In addition, when the fibers are bonded to each other via the resin, the fibers may be parallel to each other and intersect each other, or the plurality of fibers may be bonded to one fiber.

In addition, in the bonding unit 77, pressure may be applied in addition to applying the heat to the mixture. In this case, the bonding unit 77 can have a function of forming the mixture in the predetermined shape. The level of the applied pressure is appropriately adjusted by the type of the paper sheet to be formed, but can be 50 kPa to 30 MPa. If the applied pressure is low, it is possible to obtain a sheet (paper sheet, non-woven fabric) having a high porosity, and if the applied pressure is high, it is possible to obtain a sheet (paper sheet, non-woven fabric) having a low porosity (high density).

Specific examples of the bonding unit 77 include a heating roller (heater roller), a heat press forming machine, a hot plate, a warm (hot) air blower, an infrared heater, or a flash fixing device. In the sheet manufacturing apparatus 1000 of the embodiment illustrated in FIG. 1, the bonding unit 77 is configured of a pair of heating rollers 78. By heating a web W, it is possible to bond the fibers included in the web W to each other via the resin. In addition, when the heating rollers 78 illustrated in the drawing is employed as a specific configuration of the bonding unit 77, compared to a case where the heat press forming machine, the warm air blower, or the infrared heater is used, it is possible to intensively give the heat to a narrow region of the web W. For this reason, compared to a case where a wide region is heated by heat press or warm air blow, it is possible to reduce the amount of energy to be used.

In the example in the drawing, the bonding unit 77 is configured to nip the web W by the heating rollers 78, heat the web W, and press the web W, and includes one pair of heating rollers 78. When the bonding unit 77 is configured of a planar pressing unit, a buffer unit (not illustrated) is provided as needed to temporarily give slack to the web that is being transferred while being pressed. Also, by configuring the bonding unit 77 from the heating rollers 78, the sheet can be formed while the web W is continuously transferred compared to when the bonding unit 77 is configured as the planer pressing unit.

The heating roller 78 is configured of a hollow core bar, such as aluminum, iron, or stainless steel. On a surface of the heating roller 78, a tube which contains fluorine, such as tetrafluoroethylene perfluoro alkyl vinyl ether copolymer (PFA) or polytetrafluoroethylene (PTFE), or a releasing layer coated with fluorine, such as PTFE, may be provided. In addition, between the core bar and the releasing layer, an elastic layer, which is made of silicon rubber, urethane rubber, or cotton, may be provided. By providing this elastic layer, when the pair of heating rollers 78 is pressing with a heavy load, the pair of heating rollers 78 can be uniformly in contact in the axial direction of the heating rollers 78.

In addition, in the center unit of the core bar, as a heating section, a heating material which is not illustrated, such as a halogen heater, is provided. The heating roller 78 and the heating material respectively obtain the temperature by a temperature detecting unit which is not illustrated based on the obtained temperature, and the driving of the heating material is controlled. Accordingly, it is possible to maintain the surface temperature of the heating rollers 78 at a predetermined temperature. By allowing the web W to pass through between the pair of heating rollers 78, it is possible to heat and press the transferred web W. In addition, the heating section is not limited to the halogen heater or the like, and for example, a heating section by a non-contact heater or a heating section by warm air may be employed.

When the heating rollers 78 are employed in the bonding unit 77, the number or the disposition of the heating rollers 78 is not limited, and it is possible to be arbitrarily configured within a range where the above-described operation is achieved. In addition, the configuration (thickness or material of a releasing layer, an elastic layer, and a core bar, outer diameter of the roller) of the heating rollers 78 of the bonding unit 77, or the load pressing on the heating rollers 78, may vary according to each pair of the plurality of heating rollers 78. Furthermore, in the example in the drawing, the web W is heated together with a mesh belt 72, but heating may be performed in a state where the web W is peeled from the mesh belt 72.

As the mixture of the defibrated material (fibers) and the additive agent (resin) passes the bonding unit 77 (heating process), the resin in the additive agent is melted, the fibers in the defibrated material are likely to be intertwined, and the fibers are bonded to each other. In this manner, the sheet S is manufactured. In the sheet manufacturing apparatus 1000 of the embodiment, the sheet is manufactured as the fibers of the defibrated material which passes through the above-described defibrating unit 20 are bonded to each other via the resin.

3. Additive Agent

The additive agent which is supplied from the supplying unit 106 and mixed with the defibrated material (fibers), includes the resin. A type of the resin may be any of a natural resin and a synthesized resin, and may be any of a thermoplastic resin and a heat-curable resin. In the sheet manufacturing apparatus 1000 of the embodiment, it is preferable that the resin is a solid at a room temperature, and it is more preferable that the resin is the thermoplastic resin when considering that the fibers are bonded by heating in the bonding unit 77.

When the thermoplastic resin is used as the resin, if heating is performed to reach a glass transfer temperature, a temperature which is equal to or greater than the vicinity of a softening point or a melting point (in a case of the crystalline polymer), the resin is softened or melted, and after this, when the temperature decreases, the resin is solidified, and accordingly, it is possible to obtain a bonding force. In addition, when the heat-curable resin is employed as the resin, heating may be performed to reach the temperature which is equal to or greater than the softening point, and it is possible to bond the fibers and the resin even when heating is performed to reach a curing temperature (temperature which causes curing reaction).

In addition, it is preferable that the melting point, the glass transfer temperature, the softening point, or the curing temperature of the resin is lower than the melting point, a decomposition temperature, and a carbonization temperature of the fibers, and in order to achieve such a relationship, it is preferable to combine and select the types of the resin and fibers.

Examples of the natural resin include rosin, dammar, mastic, copal, amber, shellac, Daemonorops draco, Sandarac, or colophonium. These examples may be used independently or by being appropriately mixed. In addition, these examples may be appropriately chemically denatured.

Examples of the heat-curable resin among the synthesized resins include a phenol resin, an epoxy resin, a melamine resin, a urea resin, an unsaturated polyester resin, an alkyd resin, polyurethane, or a heat-curable polyimide resin.

In addition, examples of the thermoplastic resin among the synthesized resins include an AS resin, an ABS resin, polypropylene, polyethylene, polyvinyl chloride, polystyrene, acrylic resin, polyester resin, polyethylene terephthalate, polyphenylene ether, polybutylene terephthalate, nylon, polyamide, polycarbonate, polyacetal, polyphenylene sulfide, or polyether ether ketone.

These resins may be used independently or by being appropriately mixed. In addition, the resins may be copolymerized or denatured, and examples of this type of resin include a styrene resin, an acrylic resin, a styrene-acrylic copolymer resin, an olefin resin, a vinyl chloride resin, a polyester resin, a polyamide resin, a polyurethane resin, a polyvinyl alcohol resin, a vinyl ether resin, an N-vinyl resin, or a styrene-butadiene resin.

The additive agent may have a fibrous form, and may have a powder-like shape. When the additive agent has a fibrous form, a fiber length of the additive agent is preferably equal to or less than a fiber length of the defibrated material. Specifically, the fiber length of the additive agent is equal to or less than 3 mm, and is more preferably equal to or less than 2 mm. When the fiber length of the additive agent is longer than 3 mm, there is a case where it is difficult to mix the defibrated material with excellent uniformity. When the additive agent has a powder-like shape, a grain size (diameter) of the additive agent is 1 μm to 50 μm, and is more preferably 2 μm to 20 μm. When the grain size of the additive agent is less than 1 μm, there is a case where the bonding force which bonds the fibers to each other in the defibrated material deteriorates. When the grain size of the additive agent is greater than 20 μm, there is a case where it is difficult to mix the defibrated material with excellent uniformity, and there is a case where unevenness is generated in the sheet to be manufactured as an adhering force to the defibrated material deteriorates and the additive agent is separated from the defibrated material.

The amount of the resin supplied from the supplying unit 106 is appropriately set in accordance with the type of the sheet to be manufactured. The proportion of the additive agents in the mixture is, for example, 5% by weight to 70% by weight. From the viewpoint of obtaining an excellent mixture and making it difficult to receive the additive agent descending due to gravity when the mixture is molded in a web shape, the proportion is preferably 5% by weight to 50% by weight.

In addition, other than the resin, the additive agent may contain other components. Examples of the other components include a coagulation inhibitor, a coloring material, an organic solvent, surfactant, an antifungal and antiseptic agent, antioxidant, ultraviolet absorber, or oxygen absorber. Hereinafter, the coagulation inhibitor and the coloring material will be described.

3.1. Coagulation Inhibitor

In addition to the resin which bonds the fibers in the defibrated material, the additive agent may include the coagulation inhibitor for suppressing coagulation between the fibers in the defibrated material or between the resins in the additive agent. In addition, when the coagulation inhibitor is included in the additive agent, it is preferable to integrate the resin and the coagulation inhibitor. In other words, when the coagulation inhibitor is included in the additive agent, it is preferable that the additive agent is a complex body which has the resin and the coagulation inhibitor integrated therein.

In the specification, when the complex body is referred, grains which have the resin as one of the components, and are formed to be integrated with other components, are indicated. Other components indicate the coagulation inhibitor or the coloring material, but also indicate components which have different shape, size, material, and functions from those of the resin which is the main component.

In a case where the coagulation inhibitor is compounded with the additive agent, compared to a case where the coagulation inhibitor is not compounded with the additive agent, it is possible to make it difficult to coagulate the complex bodies having the resin and the coagulation inhibitor integrated therein, with each other. As the coagulation inhibitor, various materials can be used. However, in the sheet manufacturing apparatus 1000 of the embodiment, since water is not used or water is rarely used in the screening unit 40 and/or the refining unit 60, it is preferable to use a material which can be disposed (coating (covering) or the like may be employed) on a surface of the complex body.

An example of the coagulation inhibitor includes fine grains which are made of inorganic substances. By disposing the fine grains on the surface of the complex body, it is possible to obtain an extremely excellent effect of coagulation suppression. In addition, coagulation means a state where the same or different types of objects exist being physically contact with each other by an electrostatic force or a Van der Waals force. In addition, in an aggregate (for example, powder) of the plurality of objects, a state of not being coagulated does not necessarily indicate a state where all of the objects which configure the aggregate are disposed to be dispersed. In other words, a state of not being coagulated, includes a state where a part of the objects which configure the aggregate is coagulated. Even when the amount of the objects which are coagulated is equal to or less than 10% by weight of the entire aggregate, and is preferably approximately equal to or less than 5% by weight, this state is included in the "state of not being coagulated" in the aggregate of the plurality of objects. Furthermore, when the powder or the like is bag-packed or the like, the grains of the powder exist being in contact with each other. However, by applying an external force to the extent that the grains are not damaged, such as smoothly stirring, scattering by the air current, and freely descending, when it is possible to make the grains be in a dispersed state, this state is included in the state of not being coagulated.

Specific examples of materials of the coagulation inhibitor include silica, titanium oxide, aluminum oxide, zinc oxide, cerium oxide, magnesium oxide, zirconium oxide, strontium titanate, barium titanate, or calcium carbonate. In addition, a part (for example, titanium oxide or the like) of the exemplified materials of the coagulation inhibitor is the same as the material of the coloring material which will be described later, but is different in that the grain size of the coagulation inhibitor is smaller than the grain size of the coloring material. For this reason, the coagulation inhibitor does not greatly influence a color tone of the sheet to be manufactured, and can be distinguished from the coloring material. However, when the color tone of the sheet is adjusted, even when the grain size of the coagulation inhibitor is small, since there is a case where some effects, such as light scattering, are generated, it is preferable to consider such effects.

The average grain size (number average grain size) of the grains of the coagulation inhibitor is not particularly limited, but is preferably 0.001 μm to 1 μm, and is more preferably 0.008 μm to 0.6 μm. The grains of coagulation inhibitor are in a category of so-called nanograins, and since the grain size is small, the grains of the coagulation inhibitor are generally primary grains. However, the grains of the coagulation inhibitor may be high order grains which are made by combining a plurality of primary grains. If the grain size of the primary grains of the coagulation inhibitor is within the above-described range, it is possible to excellently perform coating on the surface of the resin, and to achieve a sufficient effect of coagulation suppression of the complex body. In the powder of the complex body in which the coagulation inhibitor is disposed on the surface of the resin grains, the coagulation inhibitor exists between a certain complex body and another complex body, and the coagulation therebetween is suppressed. In addition, when the resin and the coagulation inhibitor are not integrated and separated from each other, since the coagulation inhibitor is not necessarily exist between a certain resin grain and another resin grain all the time, the effect of coagulation suppression between the resin grains decreases compared to a case where the resin and the coagulation inhibitor are integrated.

It is preferable that the content of the coagulation inhibitor in the complex body in which the resin and the coagulation inhibitor are integrated is 0.1 parts by weight to 5 parts by weight with respect to 100 parts by mass of the resin. With this content, it is possible to obtain the above-described effects. In addition, from the viewpoint of enhancing the above-described effects and/or preventing the coagulation inhibitor from falling out from the sheet to be manufactured, with respect to 100 parts by weight of the resin, the content is preferably 0.2 parts by weight to 4 parts by weight, and is more preferably 0.5 parts by weight to 3 parts by weight.

When the coagulation inhibitor is disposed on the surface of the resin, if the proportion of covering the surface of the complex body with the coagulation inhibitor (area ratio: there is a case where the area ratio is referred to as a coverage in the specification) is 20% to 100%, it is possible to obtain sufficient effects of coagulation suppression. The coverage can be adjusted by charging the apparatus, such as an FM mixer. Furthermore, if a specific surface area of the coagulation inhibitor and the resin is known, it is possible to adjust the coverage by mass (weight) of each component when charging. In addition, the coverage can be measured by various types of electron microscopes. In addition, in the complex body in which the coagulation inhibitor is disposed in a state of being unlikely to be fallen out from the resin, the coagulation inhibitor and the resin can be integrated.

When the coagulation inhibitor is compounded with the complex body, since it is possible to make it extremely difficult to cause the coagulation of the complex body, in the housing unit 104, it is possible to easily mix the defibrated material (fibers) which passes holes H of the cylinder unit 102, and the additive agent (complex body). In other words, when the coagulation inhibitor is compounded with the additive agent as the complex body with the resin, the complex body is quickly scattered to a space 2, and it is possible to form the mixture of the defibrated material and the additive agent faster and more uniformly compared to a case where the coagulation inhibitor is not compounded. One of the reasons why fibers and the resin (complex body) can be excellently mixed by the coagulation inhibitor, is that the complex body tends to have static electricity when the coagulation inhibitor is disposed on the surface of the complex body, and the coagulation of the complex body is suppressed by the static electricity.

3.2. Coloring Material

In addition to the resin which bonds the fibers of the defibrated material, the additive agent may include the coloring material. In addition, when the coloring material is included in the additive agent, it is preferable to integrate the resin and the coloring material. In other words, it is preferable that the additive agent is a complex body in which the resin and the coloring material are integrated. In addition, even when the complex body includes the above-described coagulation inhibitor, the complex body can have the resin, the coloring material, and the coagulation inhibitor integrated. In other words, the additive agent may include the complex body in which the resin, the coagulation inhibitor, and the coloring material are integrated.

The complex body in which the resin and the coloring material are integrated, in the sheet manufacturing apparatus 1000, and/or in the sheet to be manufactured, refers to a state where the coloring material is in a state of being unlikely to come apart (unlikely to be fallen out). In other words, the complex body in which the resin and the coloring material are integrated indicates a state where the coloring materials are stuck to each other by the resin, a state where the coloring material is structurally (mechanically) fixed to the resin, a state where the resin and the coloring material are coagulated by an electrostatic force or a Van der Waals force, and a state where the resin and the coloring material are chemically combined. In addition, a state where the complex body has the resin and the coloring material integrated therein may be a state where the coloring material is in the resin, and may be a state where the coloring material is adhered to the resin, and includes a state where the two states exist at the same time.

The coloring material has a function of making a color of the sheet to be manufactured a predetermined color by the sheet manufacturing apparatus 1000 of the embodiment. As the coloring material, it is possible to use dye or pigments, and when the coloring material is integrated with the resin as the complex body, it is preferable to use the pigments from the viewpoint of obtaining more excellent hiding power or chromogenic properties.

The color and the type of pigments are not particularly limited, and for example, it is possible to use pigments having various colors (white, blue, red, yellow, cyan, magenta, yellow, black, or special colors (pearl or metallic luster)) which are generally used in ink. The pigments may be inorganic pigments, and may be organic pigments. As the pigments, it is possible to use known pigments described in JP-A-2012-87309, or in JP-A-2004-250559. In addition, white pigments, such as zinc white, titanium oxide, antimony white, zinc sulfide, clay, silica, white carbon, talc, or alumina white, may be used. These pigments may be used independently, and may be used by being appropriately mixed. In addition, when the white pigments are used, among the above-described examples, it is more preferable to use the pigments which are made of powder including grains (pigment grains) which has titanium oxide as a main component since it is easy to enhance the whiteness of the sheet S to be manufactured with a small compound amount, by a high refractive index of titanium oxide.

4. Screening Unit and Refining Unit

The sheet manufacturing apparatus 1000 of the embodiment includes at least one of the screening unit 40 and the refining unit 60. At least one of the screening unit 40 and the refining unit 60 has a function of mixing the defibrated material including the fibers which are defibrated by the defibrating unit 20, and the additive agents. In the example illustrated in FIG. 1, both the screening unit 40 and the refining unit 60 are provided, but one of the screening unit 40 and the refining unit 60 may be provided, or the plurality of screening units 40 and the refining units 60 may be provided. In at least one of the screening unit 40 and the refining unit 60, a group of the cylinder unit 102, the housing unit 104, and the supplying unit 106, is provided, and in at least one of the screening unit 40 and the refining unit 60 including the group, the defibrated material (the mixture of the defibrated material and the additive agents may be employed) and the additive agents are mixed in. In addition, when the group is provided in both the screening unit 40 and the refining unit 60, the additive agents added to both the screening unit 40 and the refining unit 60 may be the same as each other and may be different from each other.

Hereinafter, the sheet manufacturing apparatus 1000 of the embodiment in which the group of the cylinder unit 102, the housing unit 104, and the supplying unit 106 is provided in both the screening unit 40 and the refining unit 60, will be described.

4.1. Screening Unit

The screening unit 40 screens long fibers from the defibrated material, or non-defibrated pieces which are not sufficiently defibrated, in the air. The screening unit 40 screens the defibrated material which is defibration-processed into a "passed material" which passes through the screening unit 40, and a "residue" which does not pass through the screening unit 40, in the air. When the screening unit 40 is employed in the sheet manufacturing apparatus 1000 of the embodiment, a sieve which will be described below is used. The screening unit 40 can screen fibers (passed material) which are shorter than a certain length from the defibrated material which is defibration-processed, by the sieve.

The sieve which is a part of the configuration of the screening unit 40 has a cylindrical surface, and includes a cylinder unit 44 (102) in which the plurality of holes H are formed at least at a part of the cylindrical surface. The inside of the cylinder unit 44 is a cavity 1, and the defibrated material (fibers) and the additive agent (resin) are introduced into the cavity 1. The cylinder unit 44 can rotate around the rotation axis R (center axis of the cylindrical surface). The introduced defibrated material is screened into fibers (passed material which passes through the holes H) which is shorter than a certain length, and fibers (residue which does not pass through the holes H) which is longer than a certain length.

Figure 2:
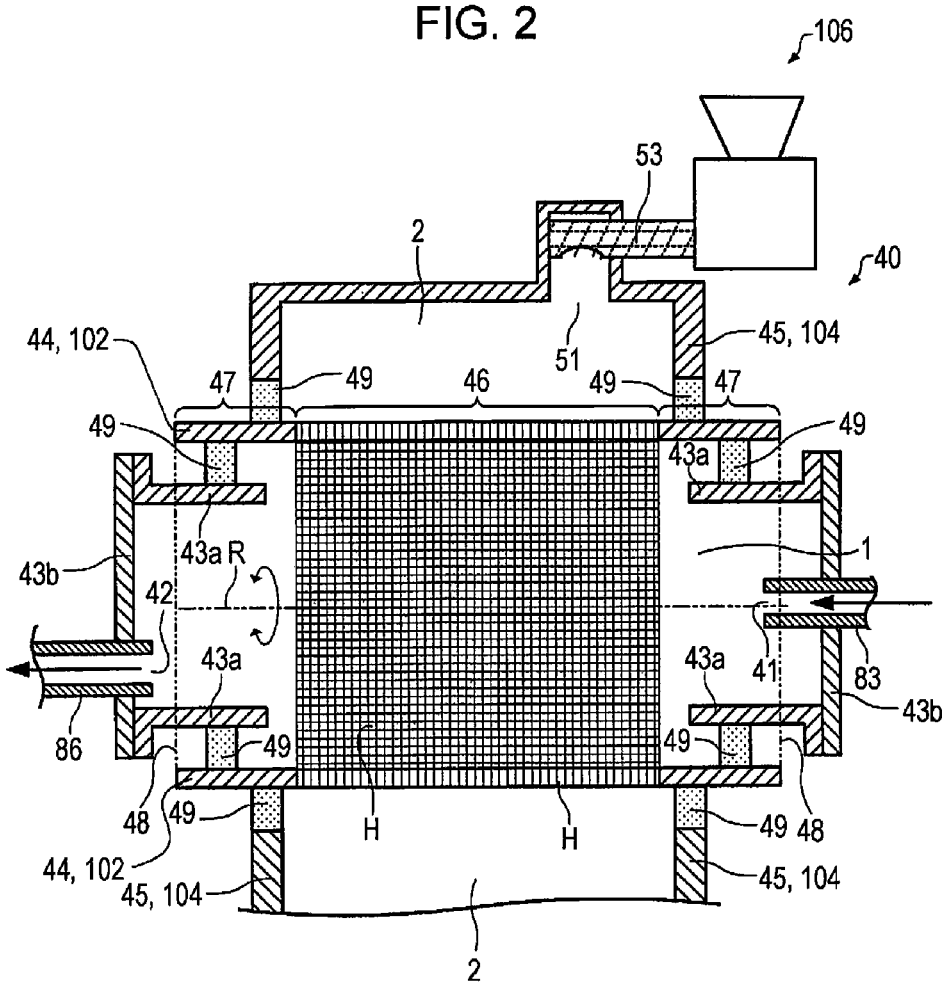
FIG. 2 is a schematic view illustrating main units of a screening unit according to the embodiment.

As illustrated in FIGS. 1 and 2, the screening unit 40 includes an introduction port 41 which introduces the defibrated material (fibers) into the cylinder unit 44, and a discharge port 42 which discharges the residue which does not pass through the holes H of the cylinder unit 44. As illustrated in FIG. 1, the residue which does not pass through the holes H of the cylinder unit 44 may be discharged from the discharge port 42, be transferred to a hopper 15 via a tube (pipe) 86 which functions as a return path, and return to the defibrating unit 20 again. The passed material which passes through the holes H of the cylinder unit 44 is transferred through a tube (pipe) 87 after being received by a hopper 16.

The introduction port 41 which introduces the defibrated material into the cavity 1 may be connected to the tube 82 which is connected to the discharge port 22 of the defibrating unit 20, and as illustrated in FIG. 1, may be connected to a tube 83 which is connected to a lower discharge port 34 of the classifying unit 30 when the classifying unit 30 is provided. In addition, in the example in the drawing, the introduction port 41 is formed to penetrate a flange fixed plate 43*b* on one end side, but may be connected to the flange fixed plate 43*b* as an opening of the flange fixed plate 43*b*. Furthermore, when viewed from the direction along the rotation axis R of the cylinder unit 44, the introduction port 41 is opened in the vicinity of the rotation axis R, but the position where the introduction port 41 is disposed is not limited.

By providing the screening unit 40, it is possible to divide the fibers and the grains which are included in the defibrated material and the mixture and which are smaller than the size of an aperture of the hole H, and the fibers, the non-defibrated pieces, and the lump which are greater than the size of the aperture of the hole H.

FIG. 2 is a schematic view illustrating an example of main units of the screening unit 40. In the example in FIG. 2, the screening unit 40 is provided with the cylinder unit 44 (102) which allows the defibrated material to pass through the plurality of holes H which are on the cylindrical surface by rotating, and a housing unit 45 (104) which covers the cylinder unit 44 so that at least a part (the plurality of holes H) of the cylinder unit 44 is included therein. As long as the cavity 1 is formed inside the cylinder unit 44, and the cylinder unit 44 can rotate around the rotation axis R, a bearing mechanism, a supporting mechanism, a rotating mechanism, and a sealing mechanism of the cylinder unit 44, are not particularly limited. The housing unit 45 may cover the entire cylinder unit 44.

In addition, the screening unit 40 is provided with the supplying unit 106 which supplies the additive agents to the space 2 which is formed on the outer side of the cylinder unit 44 and the inner side of the housing unit 45. In addition, the screening unit 40 can be configured similarly to the refining unit 60 which will be described later, except that the discharge port 42 is provided. However, unlike the refining unit 60, the screening unit 40 does not allow all of the introduced materials to pass through, and has a function of removing some components from the discharge port 42.

In the example illustrated in FIG. 2, the cylinder unit 44 includes an opening region 46 which has the plurality of holes H through which the fibers (defibrated material) pass, and a tubular region 47 which does not have the holes H. The opening region 46 and the tubular region 47 are welded or fastened by a screw or the like, and integrally rotate. The cylinder unit 44 in the drawing is formed in a tubular shape by using a metal plate, such as stainless steel having a uniform thickness, and openings 48 are formed at both ends the cylinder unit 44.

In the opening region 46, the plurality of holes H is provided. The opening region 46 is configured so that the mixture passes through the holes H, and the size or a forming region of the holes H is appropriately set by the size or the type of the materials. In addition, the opening region 46 is not limited to a punching metal, and may be a mesh material. The size (area) of the plurality of holes H may be the same as each other, and each of the holes H may be disposed with an equivalent interval. Accordingly, it is possible to uniformly scatter the mixture which passes through the holes H, and to make the size or the like of the mixture more uniform.

The tubular region 47 is a part where the holes H are not provided, engages with the housing unit 45, and defines the space 2, at which the mixture that passes through the holes H of the cylinder unit 44 is collected, together with the housing unit 45. In addition, the tubular region 47 engages with a flange unit 43*a*, and defines the cavity 1 on the inner side of the cylinder unit 44.

The housing unit 45 includes the space 2 on the inner side thereof. As illustrated in FIG. 1, below the housing unit 45, there is no wall surface, and the mixture which passes through the holes H descends to the hopper 16. In addition, as illustrated in FIG. 2, the housing unit 45 includes two facing wall surfaces having an opening which the cylinder unit 44 rotatably penetrates. Along an edge of the opening, a pile seal 49 is provided, and the surface of the tubular region 47 of the cylinder unit 44 and the pile seal 49 are in contact with each other. In this manner, as the housing unit 45 and the tubular region 47 are in contact with each other, it is possible to prevent the fibers which pass through the holes H of the opening region 46 from being scattered to the outside from the inside of the housing unit 45. In a direction which intersects the direction along the rotation axis R of the cylinder unit 44, the dimension of the opening of the housing unit 45 becomes greater than the dimension of an outer diameter of the cylinder unit 44, and thus, the housing unit 45 is disposed on the inner side of the cylinder unit 44.

As illustrated in FIG. 2, the cylinder unit 44 includes the tubular region 47, the opening region 46, and the tubular region 47, along an extending direction of the rotation axis R. As illustrated in FIG. 2, the housing unit 45 is in contact with the surface (cylindrical surface) on a side which separates from the rotation axis R in the tubular region 47, via the pile seal 49.

For example, the pile seal 49 is configured of a brush in which thin bristles are densely implanted on one surface side of a base unit. In the pile seal 49, the thin bristles are densely implanted to the extent that the fibers (defibrated material) which passes through the holes H of the cylinder unit 44 and the additive agents supplied from the supplying unit 106 cannot pass through. A tip end unit of a brush of the pile seal 49 is configured to be in contact with the surface of the tubular region 47. It is preferable that there is no opening on the surface of the tubular region 47 with which the pile seal 49 is in contact, and there is no unevenness at least on the surface with which the pile seal 49 is in contact. Accordingly, the void between the housing unit 45 and the tubular region 47 of the cylinder unit 44 is blocked to the extent that the fibers or the additive agents cannot pass through, by the pile seal 49. Therefore, it is possible to prevent the mixture which passes through the holes H of the cylinder unit 44 from leaking to the outside of the housing unit 45.

In addition, by employing the pile seal 49, when the cylinder unit 44 rotates around the rotation axis R, friction in a sliding unit between the tubular region 47 and the pile seal 49 is suppressed, and it is possible to reduce a rotational load to the cylinder unit 44. In addition, since the pile seal 49 is reliably in contact with the tubular region 47, it is preferable that the length of the thin bristles of the brush of the pile seal 49 is set to be longer than a distance between the housing unit 104 and the tubular region 47 of the cylinder unit 44.

In addition, the pile seal 49 may be connected to the tubular region 47 side of the cylinder unit 44. However, when the cylinder unit 44 is shifted in the direction along the rotation axis R with respect to the housing unit 45, there is a case where a contact area between the pile seal 49 and the housing unit 45 decreases. For this reason, it is preferable that the pile seal 49 is connected to the housing unit 45 side, and is in contact with the tubular region 47 which is greater than the pile seal 49 in the direction along the rotation axis R. In this manner, the space 2 on the outer side of the cylinder unit 44 (102), which is divided by the cylinder unit 44 (102), the pile seal 49, and the housing unit 45 (104), is formed.

Meanwhile, as illustrated in FIG. 2, in both end units in the direction along the rotation axis R of the cylinder unit 44, and on an inner side of the tubular region 47 of the cylinder unit 44, a pair of flange units 43*a* is provided. The tubular region 47 and the flange unit 43*a* are in contact with each other via the pile seal 49. The flange unit 43*a* is fixed to the flange fixed plate 43*b*. The flange fixed plate 43*b* is fixed to an external frame which is not illustrated. The pile seal 49 is functionally similar to the description above, and the detail description thereof will be omitted.

In this manner, the cavity 1 inside the cylinder unit 44 (102), which is divided by the cylinder unit 44 (102), the pile seal 49, the flange unit 43*a*, and the flange fixed plate 43*b*, is formed. In addition, the example in the drawing illustrates a state where the flange unit 43*a* goes into the inner side (side which approaches the rotation axis R) of the cylinder unit 44, and the flange fixed plate 43*b* is disposed on the outer side of the cylinder unit 44 in the direction (extending direction) along the rotation axis R. However, the invention is not limited to this state, and as long as the cavity 1 can be formed on the inner side of the cylinder unit 44, any configuration may be appropriately employed. For example, the flange unit 43*a* may be engaged with the outer side (side which approaches the rotation axis R) of the cylinder unit 44, and the flange fixed plate 43*b* may be disposed on the inner side of the cylinder unit 44 in the direction along the rotation axis R.

Two flange fixed plates 43*b* can be considered as two side surface units of the cavity 1, which intersect the cylindrical surface of the cylinder unit 44, are apart in the extending direction (direction along the rotation axis R) of the rotation axis R of the cylinder unit 44, and do not rotate. The cylinder unit 44 is rotationally driven around the rotation axis R by a driving unit (appropriately configured of a motor, a belt, a pulley, a chain, or a sprocket) which is not illustrated. Accordingly, the defibrated material (fibers) which is introduced and supplied to the inside of the cylinder unit 102 is stirred, and it is possible to screen the fibers which are smaller than the aperture of the hole H, and the fibers, the non-defibrated pieces, or the lump which is greater than the aperture of the hole H.

The supplying unit 106 supplies the additive agents through a supply port 51 to the outer side of the cylinder unit 44 (102) and the inner side of the housing unit 45 (104). In the example in FIG. 2, the supplying unit 106 is configured of a screw feeder 53 and the supply port 51.

The additive agents fed into the screw feeder 53 is transferred to the supply port 51 by the screw of the screw feeder 53. The supply port 51 penetrates the inner side of the housing unit 45, and the additive agents is supplied into the housing unit 45 from the supply port 51. The additive agents may descend due to gravity into the housing unit 45 from the supply port 51, and an air blower or the like which is not illustrated may be provided for supplying the additive agents.

In the space 2 on the outer side of the cylinder unit 44 and the inner side of the housing unit 45, as the cylinder unit 44 rotates, the defibrated material (fibers) which passes through the plurality of holes H of the cylinder unit 44 is scattered. In this state, as the additive agents are supplied to the space 2 from the supply port 51, the defibrated material (fibers) and the additive agents are likely to be mixed in the atmosphere. In addition, there is a case where a disorderly air current is generated in the space 2. In a state where the cylinder unit 44 rotates (in a state where the apparatus is running), when there is the air current, the defibrated material (fibers) which passes through the holes H of the cylinder unit 44 is scattered and is likely to be mixed with the additive agents. Then, the mixture of the defibrated material (fibers) and the additive agents is made and descends to the hopper 16.

The number of revolution of the cylinder unit 44 is appropriately set, but when the cylinder unit 44 is rotated with high speed, the strong and disorderly air current is generated in the space 2. For this reason, it is preferable to connect the screw feeder 53 to the supply port 51 without a void.

In addition, in the example in FIG. 2, the supply port 51 is provided at a position which is closer to the introduction port 41 than the center of the cylinder unit 44 in the direction along the rotation axis R. In other words, the introduction port 41 is positioned on one end side of the cylinder unit 44 in the extending direction of the rotation axis R, and the supply port 51 is provided at a position close to one end side of the cylinder unit 44 in the extending direction of the rotation axis R.

Since the defibrated material is introduced from the introduction port 41, and a part thereof passes through the holes H and goes to the space 2, an abundance of the defibrated material in the cavity 1 increases on a side close to the introduction port 41. In addition, for this reason, the amount of the fibers (defibrated material) which pass through the holes H increases on the side close to the introduction port 41 of the opening region 46. Therefore, as illustrated in FIG. 2, as the supply port 51 is provided on the side close to the introduction port 41, it is possible to supply more additive agents to the side (one end side) close to the introduction port 41. Accordingly, it is possible to excellently mix the defibrated material and the additive agents.

In addition, in FIG. 2, the screw feeder 53 is disposed above the space 2. Not being limited thereto, the screw feeder 53 may be positioned in the space 2. In this case, a part where the additive agents are supplied from the screw feeder 53 is the supply port 51. Similarly to FIG. 2, when the supply port 51 and the screw feeder 53 are provided to be protruded upward from the housing unit 45, it is possible to prevent the additive agents from being adhered to the screw feeder 53.

FIGS. 3 and 4 are schematic views when the cylinder unit 44 and the housing unit 45 of the screening unit 40 viewed from the direction along the rotation axis, and are views illustrating a position where the supply port 51 is provided. As illustrated in FIG. 3, the supply port 51 of the supplying unit 106 can be disposed to be apart above the cylindrical surface of the cylinder unit 44. Here, a region above the cylindrical surface is a region which is illustrated by hatching in FIG. 3. In other words, a region which includes a region A (that is, a region A which becomes a shadow when the cylindrical surface is projected vertically upward) which is vertically above the entire cylindrical surface, and a region B above a top unit of the cylindrical surface in a vertical direction, is called a region A∪B. As the supply port 51 is provided in the region A∪B, it is possible to make it difficult to block the dispersion of the defibrated material which passes through the holes H of the cylindrical surface. In addition, since the additive agents are supplied from above to the inner side of the housing unit 45, it is possible to more efficiently mix the fibers (defibrated material) which are dispersed in the space 2. In addition, in this case, even when the additive agents are adhered to the cylinder unit 44, it is possible to make the additive agents on the inner side of the housing unit 45 disperse again by the centrifugal force which is generated by the rotation of the cylinder unit 44.

Furthermore, as illustrated in FIG. 4, the supply port 51 may be disposed to be apart from the cylindrical surface of the cylinder unit 44 in the horizontal direction. Here, the region which is apart from the cylindrical surface in the horizontal direction, is a region C which is illustrated by hatching in FIG. 4. In other words, the region indicates the region C which is separated in the horizontal direction from an end part of the cylindrical surface in the horizontal direction. In this manner, since the additive agents are supplied to a position which is apart from the cylinder unit 44 in the horizontal direction, it is possible to reduce the proportion of the additive agents which descend to the cylinder unit 44 due to the operation of gravity. For this reason, it is possible to reduce the amount of the additive agents which are adhered to the cylindrical surface, and to more excellently mix the defibrated material and the additive agents.

4.2. Deformation of Supplying Unit

Figure 5:
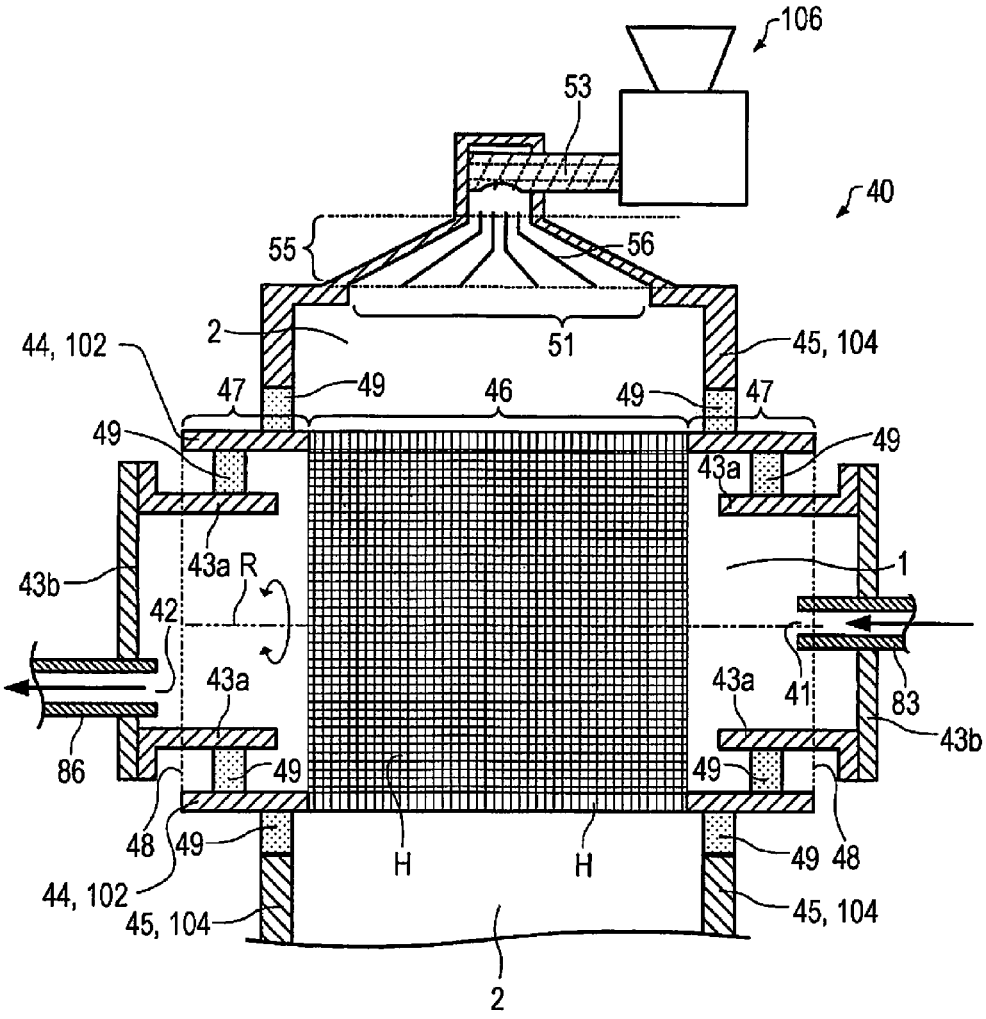
FIG. 5 is a schematic view illustrating the main units of the screening unit according to the embodiment.

FIG. 5 is a schematic view illustrating the screening unit 40 which is configured as the supplying unit 106 includes a guide unit 55. Except that the configuration of the supplying unit 106 is different, the screening unit 40 is similar to the above-described screening unit 40. Therefore, the parts which have the same operations and functions are given the same reference numerals, and the detail description thereof will be omitted.

In the screening unit 40 illustrated in FIG. 5, the guide unit 55 is provided between an exit of the screw feeder 53 and the supply port 51. The additive agents which are fed into the screw feeder 53 are transferred to the guide unit 55 by the screw feeder 53. The guide unit 55 goes through (communicates with) the supply port 51, and the additive agents are supplied to the inner side of the housing unit 104 via the guide unit 55 and the supply port 51.

The guide unit 55 is configured to distribute the additive agents which descend from the exit of the screw feeder 53 in the direction along the rotation axis R of the cylinder unit 44, and to guide the additive agents into the housing unit 45 from the supply port 51. In the example in the drawing, the guide unit 55 has an inner shape of a frustum (truncated cone or pyramid) which has a small cross-sectional area on the exit side of the screw feeder 53 and a large cross-sectional area on the housing unit 45 side, and has a partition 56 which performs an operation of widening the position where the additive agents descending from the supply port 51 descends inside thereof. In other words, the guide unit 55 forms a structure which is similar to a manifold. The guide unit 55 is a distribution mechanism which distributes the additive agents in the direction along the rotation axis R of the cylinder unit 44, and guides the additive agents into the housing unit 45. The shape of the guide unit 55 and the number or the shape of the partition 56 are not particularly limited. In addition, in the guide unit 55, the air blower or the like which is not illustrated and which carries the additive agents may be provided.

If the supplying unit 106 is provided, it is possible to distribute and supply the additive agents in the direction along the rotation axis R of the cylinder unit 44. Accordingly, it is possible to more excellently mix the defibrated material and the additive agents. In other words, the disorderly air current is generated in the space 2 by the rotation of the cylinder unit 44 (102), but regarding directional components of the air current, there are many directional components along the rotation of the cylinder unit 44. For this reason, when the inner shape of the housing unit 45 (104) is a monotonic shape, there is a case where the amount of the directional components of the air current decreases in the direction along the rotation axis R of the cylinder unit 44. In this case, the dispersion of the additive agents in the direction along the rotation axis R is unlikely to be generated. However, by providing the guide unit 55 (distribution mechanism), it is possible to make the supply amount of the additive agents in the direction along the rotation axis R uniform.

In addition, in the example in FIG. 5, the guide unit 55 equally distributes the additive agents in the direction along the rotation axis R of the cylinder unit 44, but may distribute more additive agents on the side closer to the introduction port 41 than the center of the cylinder unit 44 in the direction along the rotation axis R. In other words, the introduction port 41 is positioned on one end side of the cylinder unit 44 in the extending direction of the rotation axis R, and the guide unit 55 (distribution mechanism) may distribute more additive agents to one end side than to the other end side of the cylinder unit 44 in the extending direction of the rotation axis R.

According to this, by the guide unit 55 (distribution mechanism), more additive agents are distributed to the side close to the introduction port 41. Since the defibrated material is supplied from the introduction port 41 on one end side, the amount of the defibrated material which passes through the holes H of the cylinder unit 44 increases at one end side, and since the guide unit 55 (distribution mechanism) distributes more additive agents to the one end side, it is possible to more excellently mix the defibrated material and the additive agents.

In addition, even in the example in FIG. 5, in a positional relationship, the supply port 51 may be disposed to be apart from the cylindrical surface of the cylinder unit 44 vertically upward, and may be disposed to be apart from the cylindrical surface of the cylinder unit 44 in the horizontal direction. Accordingly, it is possible to obtain similar effects that are already described.

Figure 6:
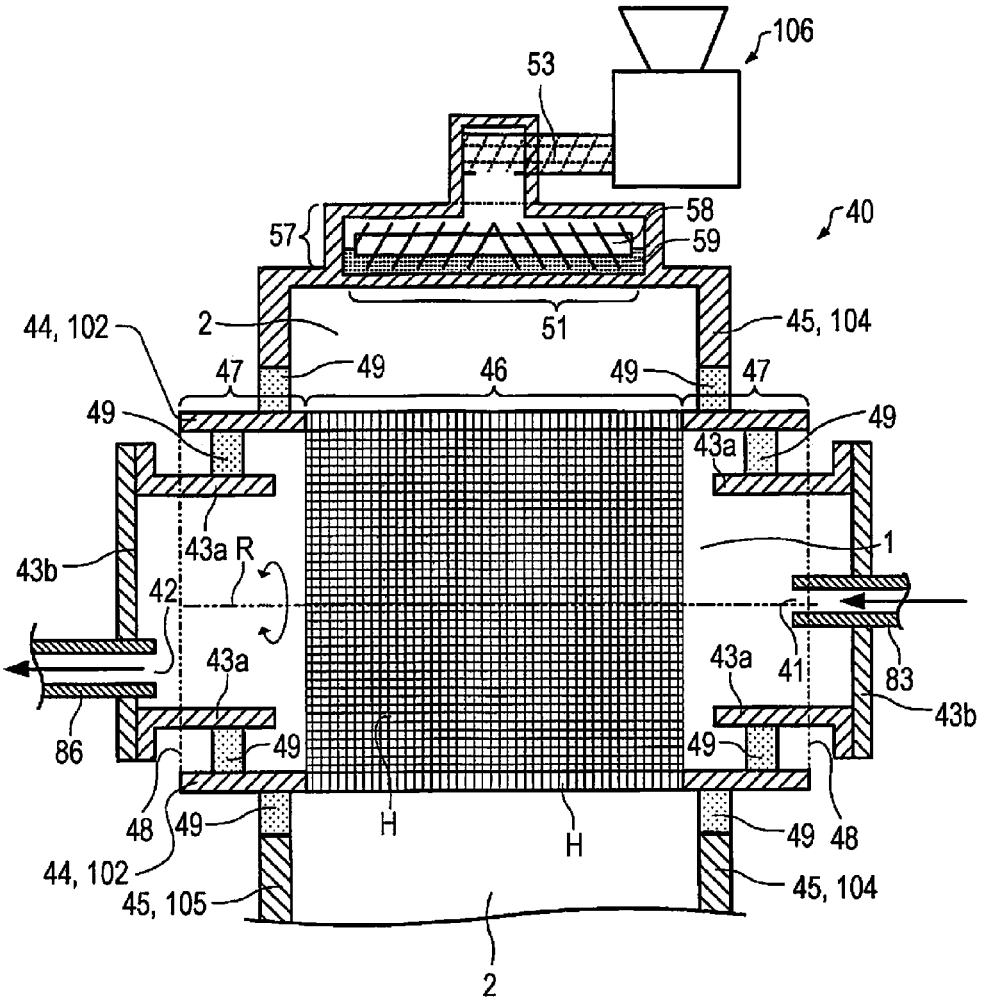
FIG. 6 is a schematic view illustrating the main units of the screening unit according to the embodiment.

FIG. 6 is a schematic view illustrating the screening unit 40 which is configured as the supplying unit 106 includes a distributing unit 57. Except that the configuration of the supplying unit 106 is different, the screening unit 40 is similar to the above-described screening unit 40. Therefore, the parts which have the same operations and functions are given the same reference numerals, and the detail description thereof will be omitted.

In the screening unit 40 illustrated in FIG. 6, the distributing unit 57 is provided between the exit of the screw feeder 53 and the supply port 51. The additive agents which are fed into the screw feeder 53 are transferred to the distributing unit 57 by the screw feeder 53. The distributing unit 57 goes through (communicates with) the supply port 51, and the additive agents are supplied to the space 2 on the inner side of the housing unit 45 (104) via the distributing unit 57 and the supply port 51.

The distributing unit 57 is configured to distribute the additive agents which descend from the screw feeder 53 in the direction along the rotation axis R of the cylinder unit 44, and to guide the additive agents into the housing unit 45 from the supply port 51. In the example in the drawing, the distributing unit 57 includes a screw 58 which rotates around one axis, and a guide plate 59. An orientation of a spiral of a blade of the screw 58 is reversed in the vicinity of the center of the longitudinal direction. The additive agents descend to the vicinity of the center of the axis of the screw 58 from the screw feeder 53, and according to this configuration, the screw 58 rotates in one direction, and thus, it is possible to split a direction of carrying the additive agents in the axial direction. In addition, it is possible to carry the additive agents toward both end sides in the longitudinal direction, and to adjust the amount of the additive agents which climb over the guide plate 59 and descend in the longitudinal direction of the screw 58 by appropriately providing the void between a tip end of the blade of the screw 58 and the guide plate 59.

In other words, the distributing unit 57 is one type of distribution mechanism which distributes the additive agents in the direction along the rotation axis R of the cylinder unit 44, and guides the additive agents to the housing unit 45 (104). The shape of the distributing unit 57 or the number or the shape of the screw 58 or the guide plate 59, are not particularly limited. In addition, although not illustrated, in the distributing unit 57, a motor which appropriately rotates the screw 58, or a mechanism which adjusts the position or the like of the guide plate 59, may be provided.

If the supplying unit 106 is provided, it is possible to distribute and supply the additive agents in the direction along the rotation axis R of the cylinder unit 44. Accordingly, it is possible to more excellently mix the defibrated material and the additive agents. In other words, by providing the distributing unit 57 (distribution mechanism), it is possible to make the supply amount of the additive agents in the direction along the rotation axis R uniform.

In addition, similarly to the example in FIG. 5, in the example in FIG. 6, the distributing unit 57 equally distributes the additive agents in the direction along the rotation axis R of the cylinder unit 44. However, for example, by adjusting a pitch of the screw 58, or by adjusting the size of the void between the guide plate 59 and the blade of the screw 58, more additive agents may be distributed on the side closer to the introduction port 41 than the center of the cylinder unit 44 in the direction along the rotation axis R. In other words, the introduction port 41 is positioned on one end side of the cylinder unit 44 in the extending direction of the rotation axis R, and the distributing unit 57 (distribution mechanism) may distribute more additive agents to one end side than to the other end side of the cylinder unit 44 in the extending direction of the rotation axis R.

According to this, by the distributing unit 57 (distribution mechanism), more additive agents are distributed to the side close to the introduction port 41. Since the defibrated material is supplied from the introduction port 41 on one end side, the amount of the defibrated material which passes through the holes H of the cylinder unit 44 increases on one end side, and since the distributing unit 57 (distribution mechanism) distributes more additive agents to one end side, it is possible to more excellently mix the defibrated material and the additive agents.

Figure 7:
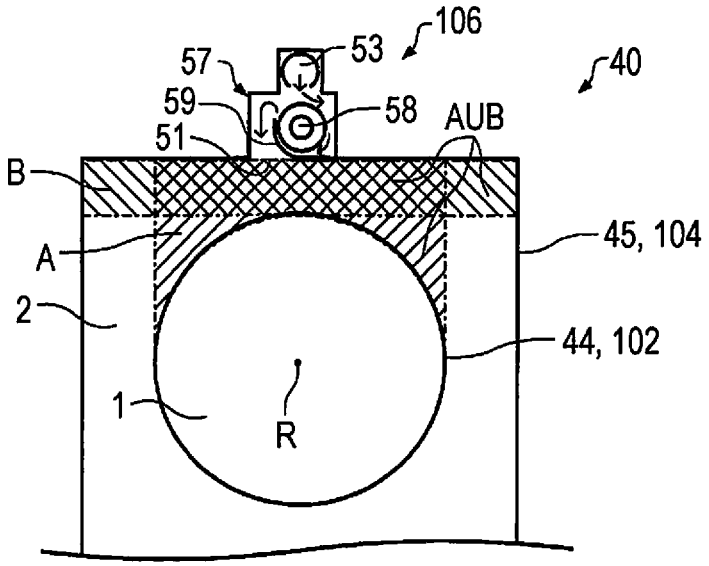
FIG. 7 is a schematic view when the cylinder unit and the housing unit of the embodiment are viewed from the direction along the rotation axis.
Figure 8:
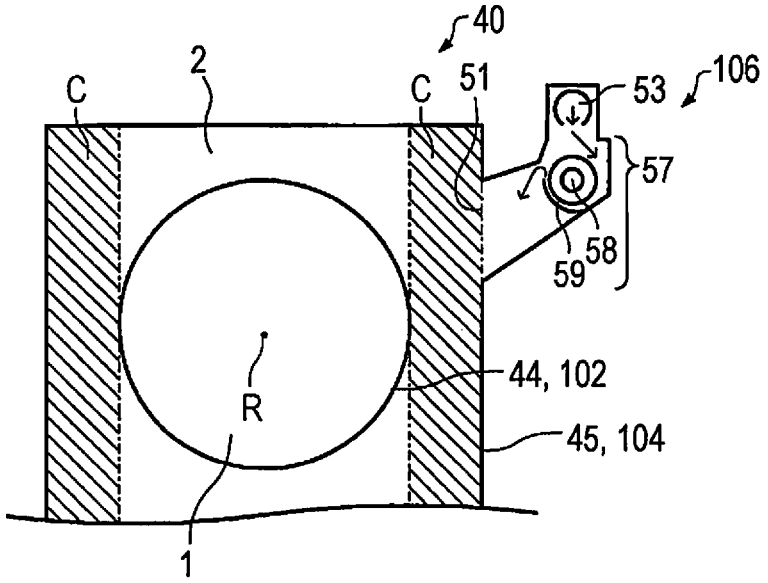
FIG. 8 is a schematic view when the cylinder unit and the housing unit of the embodiment are viewed from the direction along the rotation axis.

FIGS. 7 and 8 are schematic views when the cylinder unit 44 and the housing unit 45 of the screening unit 40 in a case where the distributing unit 57 is provided are viewed from the direction along the rotation axis. The hatchings in FIGS. 7 and 8 are similar to those in FIGS. 3 and 4. In addition, in FIGS. 7 and 8, a state of movement of the additive agent in the distributing unit 57 of the supplying unit 106 is drawn by arrows.

Even when the distributing unit 57 is provided, the supply port 51 of the supplying unit 106 can be disposed (disposed in the region A∪B) to be apart from the cylindrical surface of the cylinder unit 44 vertically upward, and according to this, it is possible to make it difficult to block the dispersion of the defibrated material which passes through the holes H of the cylindrical surface. Furthermore, even when the distributing unit 57 is provided, as illustrated in FIG. 8, the supply port 51 can be disposed (disposed in the region C) to be apart from the cylindrical surface of the cylinder unit 44 in the horizontal direction, and according to this, the additive agents are supplied to the position which is apart from the cylinder unit 44 in the horizontal direction. Therefore, it is possible to reduce the proportion of the additive agents which descend to the cylinder unit 44 due to the operation of gravity. For this reason, it is possible to reduce the amount of the additive agents which are adhered to the cylindrical surface, and to more excellently mix the defibrated material and the additive agents.

In addition, in any examples of the above-described screening unit 40, the supplying unit 106 is configured to include the screw feeder 53 which supplies the additive agents to the supply port 51, but the additive agents may be supplied by using a mechanism of opening/closing or the like a valve. In addition, a disc feeder which is not illustrated may be used in supplying the additive agents. It is more preferable to use these feeders, since it is possible to reduce variation in the supply amount of the additive agents by using these feeders. In addition, in the example of the above-described screening unit 40, one supplying unit 106 is provided, but a plurality of supplying units 106 may be provided. Other supplying units 106 in this case are also similarly configured to the description above.

The additive agents supplied from the supplying unit 106 include the resin for bonding the plurality of fibers. At the point of time when the additive agents are supplied to the space 2 in the housing unit 45 (104), the plurality of fibers included in the defibrated material are not bonded to each other intentionally except a case where defibration is not sufficiently performed. The resin which is included in the additive agent is melted or softened when passing through the bonding unit 77, and after this, the plurality of fibers are bonded to each other by hardening.

4.3. Refining Unit

In the sheet manufacturing apparatus 1000 of the embodiment, the refining unit 60 is provided downstream of the screening unit 40. The refining unit 60 performs an operation of refining the intertwined fibers, sending down the mixture, and uniformly depositing the mixture in a sheet forming unit 70 which will be described later. In other words, the word "refine" includes an operation of making the intertwined material come apart and the operation of uniformly depositing the mixture. In addition, the refining unit 60 achieves an effect of uniformly depositing the material if there are no intertwined materials.

In addition, an expression "refine the intertwined fibers" includes a case where the intertwined fibers are completely refined (a case where all of the fibers are refined), and a case where a part of the intertwined fibers is refined to the extent that the intertwined fibers pass through the sieve. An expression "refine the intertwined resin" (a case where the resin is in a fibrous form, or the like) also has a similar meaning.

In a case where the refining unit 60 is employed in the sheet manufacturing apparatus 1000 of the embodiment, the sieve is used. The sieve is similar to the sieve which is a part of the configuration of the screening unit 40 described in the sections "4.1. Screening Unit", and "4.2. Deformation of Supplying Unit", and includes a cylinder unit 64 (102) which allows the defibrated material (or the mixture of the defibrated material and the additive agents) to pass through the plurality of holes H which are on the cylindrical surface by rotating, a housing unit 65 (104) which covers the cylinder unit 64 so that at least a part (the plurality of holes H) of the cylinder unit 64 (102) is included therein, and the supplying unit 106 which is on the outer side of the cylinder unit 64 and supplies the additive agents to the inner side of the housing unit 65.

The defibrated material (when the screening unit 40 includes the supplying unit 106, the additive agent is included here) which passes through the screening unit 40 is introduced into the cylinder unit 64 from a supply port 61 via the tube 87.

In addition, in the example in FIG. 1, the supplying unit 106 in the refining unit 60 is configured of the screw feeder 53, and supplies the additive agents into the housing unit 65 through the supply port 61. In other words, the refining unit 60 can be configured similarly to the above-described screening unit 40, except that the discharge port 42 which exists in the screening unit 40 is not provided, and that the mixture which is made by mixing the defibrated material that passes through the holes H of the cylinder unit 44 (102) and the additive agents is received by the mesh belt 72 instead of the hopper 16.

Therefore, since the tube 87, the supply port 61, the cylinder unit 64 (102), the housing unit 65 (104), the supply port 61, and the supplying unit 106 in the refining unit 60, are respectively similar to the tube 83, the introduction port 41, the cylinder unit 44 (102), the housing unit 45 (104), the supply port 51, and the supplying unit 106 in the above-described screening unit 40, the detail description thereof will be omitted.

With reference to FIG. 2, the cylinder unit 64 (102) which is employed in the refining unit 60 is configured not to be provided with the tube 86 and the discharge port 42. Therefore, the sieve of the refining unit 60 is in a state where the opening for the discharge port 42 is not provided in the flange fixed plate 43*b*.

The inside of the cylinder unit 64 is the cavity 1, and the defibrated material (fibers) (a case where the screening unit 40 is not provided, or a case where the additive agent (resin) is not supplied in the screening unit 40), or the mixture (a case where the additive agent (resin) is supplied in the screening unit 40), is introduced into the cavity 1. In addition, when the additive agent is introduced in the screening unit 40, the supplying unit 106 may not be provided in the refining unit 60. Inversely, when the additive agent is introduced in the refining unit 60, the screening unit 40 or the supplying unit 106 of the screening unit 40 may not be provided. When the additive agent is introduced in the screening unit 40, and the supplying unit 106 is also provided in the refining unit 60, the same additive agent or different additive agent may be respectively introduced.

Similarly to the description about the screening unit 40, the cylinder unit 64 (102) of the refining unit 60 can rotate around the rotation axis R (center axis on the cylindrical surface), and the introduced defibrated material (fibers) and the additive agent (resin) are mixed in.

The sheet manufacturing apparatus 1000 of the embodiment includes the sheet forming unit 70 which deposits the mixture which passes through the cylinder unit 64 (102) of the refining unit 60 and forms the web W. In addition, in the sheet forming unit 70, the mesh belt 72 and a suction mechanism 76 are provided. The refining unit 60 can send down the mixture while scattering the mixture in the air. By the mesh belt 72 of the sheet forming unit 70, the refining unit 60 is in a state where the mixture which is sent down from the refining unit 60 is deposited in the air and forms a web W shape, and the refining unit 60 is one of an air laid types. In addition, the refining unit 60 may allow all of the introduced materials to pass through.

5. Other Configurations

In addition to the above-described configuration, the sheet manufacturing apparatus 1000 of the embodiment can be configured to include, for example, a crushing unit, a classifying unit, a sheet forming unit, a pressing unit, and a cutting unit.

5.1. Crushing Unit

The sheet manufacturing apparatus 1000 of the embodiment may include the crushing unit 10. The crushing unit 10 is, for example, a shredder. The crushing unit 10 cuts out the raw material of the sheet manufacturing apparatus 1000 of the embodiment in the air before the raw material is introduced into the defibrating unit 20. The shape or the size of the small pieces is not particularly limited, but for example, the raw material may be cut out to several centimeters square. In the example in the drawing, the crushing unit 10 includes a crushing blade 11, and it is possible to cut out the fed raw material by the crushing blade 11. In the crushing unit 10, an automatic feeding unit (not illustrated) for sequentially feeding the raw material may be provided in the crushing unit 10.

The small pieces which are cut out by the crushing unit 10 are transferred to the defibrating unit 20 via a tube (pipe) 81 after being received by the hopper 15. The tube 81 communicates with the introduction port 21 of the defibrating unit 20.

5.2. Classifying Unit

The sheet manufacturing apparatus 1000 of the embodiment may include the classifying unit 30 which classifies the impurities (toner or paper strengthening agent) from the defibrated material, and the fibers (short fiber) which are shortened by defibration, in the air.

The classifying unit 30 separates and removes the resin grain and the ink grains from the defibrated material. As the classifying unit 30, it is possible to use an airflow classifier. The airflow classifier generates a swirling air current (rotating airflow) to separate according to the sizes and densities of the materials classified by the centrifugal force. The classification point can be adjusted by adjusting the velocity of the airflow and the centrifugal force. Specifically, as the classifying unit 30, a cyclone, an elbow jet, or an Eddy classifier, is used. In particular, since the cyclone has a simple structure, it is possible to appropriately use the cyclone as the classifying unit 30. Hereinafter, a case where the cyclone is used as the classifying unit 30 will be described.

The classifying unit 30 includes at least an introduction port 31, the lower discharge port 34 which is provided in a lower unit, and an upper discharge port 35 which is provided in an upper unit. In the classifying unit 30, the air current which has the defibrated material introduced from the introduction port 31 is circumferentially moved, and accordingly, the centrifugal force is applied to the introduced defibrated material, and the defibrated material is separated into a first classified material (disentangled fiber) and a second classified material (resin grains, ink grains, or the like) which has a lower density than that of the first classified material. In the example in the drawing, the first classified material is discharged from the lower discharge port 34, and introduced into the introduction port 41 of the screening unit 40 through the tube 83. Meanwhile, the second classified material is discharged to the outside of the classifying unit 30 through a tube (pipe) 84 from the upper discharge port 35. In this manner, even when the sheet which includes the resin is used as the raw material, the resin grains in the defibrated material are discharged to the outside of the classifying unit 30. For this reason, even when the resin is newly supplied by the supplying unit 106, there being an excessive amount of resin with respect to the fibers in the defibrated material is prevented.

In addition, it is described that the first classified material and the second classified material are separated by the classifying unit 30, but an accurate separation is not possible. There is a case where the first classified material which has a relatively small size and a low density among the first classified materials, is discharged to the outside together with the second classified material. There is a case where the second classified material which has a relatively high density or is bonded to the first classified material among the second classified materials, is introduced into the screening unit 40 together with the first classified material. In addition, when the raw material is not the waste paper sheet, but the pulp sheet, since the material which corresponds to the second classified material is not included, the classifying unit 30 may not be provided in the sheet manufacturing apparatus 1000.

5.3. Sheet Forming Unit

The sheet manufacturing apparatus 1000 may include the sheet forming unit 70. The mixture of the fibers which pass through the refining unit 60 and the additive agents, is deposited in the sheet forming unit 70. As illustrated in FIG. 1, the sheet forming unit 70 includes the mesh belt 72, a stretching roller 74, and the suction mechanism 76. The sheet forming unit 70 may be configured to include a tension roller or a winding roller which is not illustrated.

The sheet forming unit 70 forms the web W in which the mixture which is sent down (dropped) from the refining unit 60 is deposited in the air (corresponds to the web forming process when matching the refining unit 60). The sheet forming unit 70 has a function of depositing the mixture which is uniformly scattered in the air by the refining unit 60, on the mesh belt 72.

Below the refining unit 60, the endless mesh belt 72 in which the mesh is formed is disposed. The mesh belt 72 stretches by the stretching roller 74 (in the embodiment, four stretching rollers 74). As at least one of the stretching rollers 74 self-rotates, the mesh belt 72 moves in one direction.

In addition, vertically below the refining unit 60, via the mesh belt 72, the suction mechanism 76 which functions as a sucking unit which generates the air current vertically downward is provided. By the suction mechanism 76, it is possible to suck in the mixture which is scattered in the air by the refining unit 60 onto the mesh belt 72. Accordingly, it is possible to suck in the mixture which is scattered in the air, and to increase a discharge speed from the refining unit 60. As a result, it is possible to enhance productivity of the sheet manufacturing apparatus 1000. In addition, by the suction mechanism 76, it is possible to form a downflow in a descending path of the mixture, and to prevent the defibrated material or the additive agent from being intertwined during decending.

By sending down the mixture from the refining unit 60 while moving the mesh belt 72, it is possible to form the elongated web W in which the mixture is uniformly deposited. Here, an expression "uniformly deposit" means a state where the deposited materials have substantially the same thickness and substantially the same density. However, since all of the deposited materials are not manufactured as the sheet S, the part which becomes the sheet S may be uniform. An expression "ununiformly deposit" means a state where the deposition is not performed uniformly.

If the mesh belt 72 can be made of a metal, a resin, cloth, or a non-woven fabric, the mixture can be deposited, and the mesh belt 72 allows the mixture to pass through the air current, any type of mesh belt may be employed. A hole diameter (diameter) of the mesh belt 72 is, for example, 60 μm to 250 μm. When the hole diameter of the mesh belt 72 is less than 60 μm, there is a case where it is difficult to form the stabilized air current by the suction mechanism 76. When the hole diameter of the mesh belt 72 is greater than 250 μm, there is a case where the fibers of the mixture enter the mesh, and unevenness of the surface of the paper sheet to be manufactured increases. In addition, the suction mechanism 76 can be configured to form an enclosure box in which a window having a desired size is opened below the mesh belt 72, to suck in the air other than from the window, and to make the inside of the box into a negative pressure by the external air.

As described above, by passing the refining unit 60 and the sheet forming unit 70 (web forming process), the web W in a state of containing a lot of air and being softly swollen is formed.

In the sheet manufacturing apparatus 1000 of the embodiment, the web W formed on the mesh belt 72 is bonded by the bonding unit 77. Since the resin is included in the web W, by heating, the fibers are bonded to each other, and the web W can be the sheet S which is the paper sheet or the non-woven fabric.

The thickness of the web W is not particularly limited, and can be a predetermined thickness by adjusting the rotational speed of the sieve of the refining unit 60, a sucking speed of the suction mechanism 76 of the sheet forming unit 70, and a transferring speed of the mesh belt 72. In addition, it is also possible to similarly adjust a grammage of the web W. The grammage is a weight per section area of the web W or the sheet S, and is generally expressed by using a section g/m$^2$. In the bonding unit 77 to be described later, there is a case where a volume of the web W decreases (pressed), but since the mass does not change, the grammage of the web W is substantially the same as the grammage of the sheet S. Therefore, the grammage of the sheet S to be manufactured by the sheet manufacturing apparatus 1000 is adjusted by the refining unit 60 and the sheet forming unit 70.

5.4. Pressing Unit

The sheet manufacturing apparatus 1000 of the embodiment may include the pressing unit which is not illustrated. The pressing unit can be disposed on a downstream side of the refining unit 60 and an upstream side of the bonding unit 77. In addition, the pressing unit or the bonding unit 77 may be provided after separating the web W from the mesh belt 72. The pressing unit may press the web W which is formed in a sheet shape after passing through the refining unit 60 and the sheet forming unit 70 without heating the web W. Therefore, the pressing unit may not include a heating section, such as a heater. In other words, the pressing unit is configured to perform calender processing.

In the pressing unit, by pressing (compressing) the web W, an interval (distance) between the fibers in the web W contracts, and the density of the web W can increase. The pressing unit can be configured to nip the web W by the rollers, and to press the web W, and can employ a pair of pressing rollers.

In the pressing unit, since only pressing is performed without heating, the resin does not melt when the resin is included in a functional material. In addition, in a case where the resin is not included in the functional material, the pressing unit has a function of enhancing the density of the web W. In the pressing unit, the web W is compressed, and the interval (distance) between the fibers in the web W contracts. In other words, the web W having a high density is formed. It is preferable that a pressing force of the pressing unit is set to be greater than a pressing force by the bonding unit 77. For example, it is preferable that the pressing force of the pressing unit is set to be 500 kgf to 3000 kgf, and the pressing force of the bonding unit 77 is set to be 30 kgf to 200 kgf. In this manner, by setting the pressing force of the pressing unit to be greater than that by the bonding unit 77, it is possible to sufficiently shorten the distance between the fibers included in the web W by the pressing unit, and by heating and pressing in this state, it is possible to form a thinner sheet (paper sheet) which has a high density and high strength.

In addition, the diameter of the pressing roller may be set to be greater than the diameter of the heating roller 78. In other words, in the transfer direction of the web W, the diameter of the pressing roller which is disposed on the upstream side is greater than the diameter of the heating roller 78 which is disposed on the downstream side. When the diameter of the pressing roller increases, it is possible to bite the web W in a state of not being compressed yet, and to efficiently transfer the web W. Meanwhile, since the web W which passes through the pressing roller is in a compressed state, and is likely to be transferred, the diameter of the heating roller 78 which is disposed on the downstream side can be smaller than that of the pressing roller. Accordingly, it is possible to reduce the size of the configuration of the apparatus. In addition, the diameter of the heating roller 78 and the diameter of the pressing roller are appropriately set in accordance with the thickness or the like of the web W to be manufactured.

5.5. Cutting Unit

The sheet manufacturing apparatus 1000 may include the cutting unit 90. As illustrated in FIG. 1, in the sheet manufacturing apparatus 1000 of the embodiment, on a downstream side of the bonding unit 77, a first cutting unit **90*a* and a second cutting unit 90*b* are disposed as the cutting unit 90 which cuts the paper sheet in a direction which intersects the transfer direction of the web W (sheet S). The cutting unit 90 can be provided as necessary. The first cutting unit 90*a* is provided with a cutter, and cuts out the sequential sheet in a sheet shape along a cutting position which is set to have a predetermined length. In addition, on the further downstream side of the sheet S in the transfer direction than the first cutting unit 90*a*, the second cutting unit 90*b* is disposed to cut the sheet S along the transfer direction of the sheet. The second cutting unit 90*b* is provided with a cutter, and cuts out (cuts) the sheet S along a predetermined cutting position in the transfer direction of the sheet S. Accordingly, the sheet S having a desired size is formed. The cut sheet S is loaded on a stacker 95** or the like.

6. Operation Effect

According to the sheet manufacturing apparatus 1000 described above, the additive agents can be supplied into the cylinder unit 102 to which the defibrated material including the fibers is introduced and which rotates. Accordingly, it is possible to excellently mix the fibers and the additive agents. For this reason, according to the sheet manufacturing apparatus 1000, it is possible to manufacture the sheet S having high uniformity in which uneven distribution of the fibers or the additive agents is suppressed.

7. Others

In the specification, an expression "uniform" indicates that, in a case of uniform scattering or mixing, in an object which defines two or more types or two or more phases of components, a relative position where one component exists with respect to other components is similar in the entire system, or the positions are the same or substantially equivalent to each other in each part of the system. In the specification, terms which mean the equivalence of the density, the distance, or the dimension, such as "uniform", "the same", or "equivalent interval", are used. It is preferable that the density, the distance, or the dimension is equivalent, but since it is difficult to be completely equivalent, these terms also include a meaning that the values are not equivalent and shifted by an accumulation of errors or irregularities.

The invention is not limited to the above-described embodiment, and further, it is possible to have various modifications. For example, the invention includes substantially the same configuration (a configuration in which the functions, the methods, and the result are the same, or a configuration in which the purpose and the effect are the same) as the described configuration in the embodiment. In addition, the invention includes a configuration in which a part which is not essential in the configuration described in the embodiment is switched. In addition, the invention includes a configuration in which the same operation effect as that of the configuration described in the embodiment is achieved, or a configuration in which the same purpose can be achieved. In addition, the invention includes a configuration in which a known technology is added to the configuration described in the embodiment.

The entire disclosure of Japanese Patent Application No. 2014-063246, filed Mar. 26, 2014 is expressly incorporated by reference herein.

What is claimed is:

1. A sheet manufacturing apparatus, comprising:

a defibrating unit which defibrates a defibration object including fibers;

a cylinder unit which includes a plurality of holes that are disposed through a cylindrical surface of the cylinder unit, the cylinder unit causing the defibrated material which has been defibrated at the defibrating unit to pass through the holes by rotating;

a housing unit which covers the cylindrical surface of the cylinder unit such that the holes are included therein;

a supplying unit which supplies additive agents to a space between the cylindrical surface of the cylinder unit and an inner side of the housing unit such that the additive agents are mixed with the fibers included in the defibrated material; and a bonding unit which forms a sheet by bonding a mixture of the fibers and the additive agents, which has come out from the housing unit, to bond the fibers via the additive agents.

2. The sheet manufacturing apparatus according to claim 1, wherein the supplying unit includes a supply port through which the additive agents are supplied to the space and which is spaced apart from and disposed above the cylindrical surface of the cylinder unit.

3. The sheet manufacturing apparatus according to claim 1, wherein the supplying unit includes a supply port through which the additive agents are supplied to the space and which is disposed to be apart from the cylindrical surface of the cylinder unit in a horizontal direction.

4. The sheet manufacturing apparatus according to claim 1, wherein the supply unit includes a distribution mechanism which distributes the additive agents in an extending direction extending along a rotation axis of the cylinder unit to supply the additive agents to the space.

5. The sheet manufacturing apparatus according to claim 4, wherein the cylinder unit includes an introduction port from which the defibrated material which has been defibrated at the defibrating unit is introduced into the cylinder unit, the introduction port is arranged to one end side in the extending direction of the cylinder unit, and the distribution mechanism distributes more additive agents to the one end side than to the other end side in the extending direction of the cylinder unit.

6. The sheet manufacturing apparatus according to claim 1, wherein the cylinder unit includes an introduction port through which the defibrated material which has been defibrated at the defibrating unit is introduced into the cylinder unit, the introduction port is arranged to one end side in an extending direction of the cylinder unit, the extending direction extending along a rotation axis of the cylinder unit, and the supplying unit includes a supply port through which the additive agents are supplied to the space and which is disposed at a position close to the one end side of the cylinder unit in the extending direction.

* * * * *